US006551375B2

(12) United States Patent
Siddle et al.

(10) Patent No.: US 6,551,375 B2
(45) Date of Patent: Apr. 22, 2003

(54) AMMUNITION USING NON-TOXIC METALS AND BINDERS

(75) Inventors: David Richard Siddle, Greensburg, PA (US); Joseph Matthew Tauber, Harrison City, PA (US); Francois-Charles Henri Dary, Ligonier, PA (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 09/800,167

(22) Filed: Mar. 6, 2001

(65) Prior Publication Data

US 2003/0056620 A1 Mar. 27, 2003

(51) Int. Cl.[7] ..... B22F 3/02; B22F 5/00

(52) U.S. Cl. ..... 75/248; 75/230; 75/245; 419/65; 419/66

(58) Field of Search ..... 419/65, 66; 75/230, 75/245, 248

(56) References Cited

U.S. PATENT DOCUMENTS

| | | | | | |
|---|---|---|---|---|---|
| 4,949,645 | A | * | 8/1990 | Hayward et al. | |
| 5,189,252 | A | | 2/1993 | Huffman et al. | 102/459 |
| 5,264,022 | A | | 11/1993 | Haygarth et al. | 75/255 |
| 5,399,187 | A | | 3/1995 | Mravic et al. | 75/228 |
| 5,527,376 | A | | 6/1996 | Amick et al. | 75/246 |
| 5,713,981 | A | | 2/1998 | Amick | 75/340 |
| 5,719,352 | A | * | 2/1998 | Griffin | 102/517 |
| 5,728,349 | A | | 3/1998 | Persson | 420/513 |
| 5,786,416 | A | * | 7/1998 | Gardner et al. | 534/440 |
| 5,814,759 | A | | 9/1998 | Mravic et al. | 102/517 |
| 5,905,936 | A | | 5/1999 | Fenwick et al. | 419/2 |
| 5,950,064 | A | | 9/1999 | Robinson et al. | 419/47 |
| 6,048,379 | A | | 4/2000 | Bray et al. | 75/229 |

FOREIGN PATENT DOCUMENTS

| | | |
|---|---|---|
| GB | 2121522 | 12/1983 |
| WO | WO9411697 | 5/1994 |
| WO | WO9611762 | 4/1996 |
| WO | WO9820294 | 5/1998 |
| WO | WO0003194 | 1/2000 |

* cited by examiner

*Primary Examiner*—Ngoclan Mai
(74) *Attorney, Agent, or Firm*—Kevin P. Weldon

(57) ABSTRACT

Tungsten powder is mixed with a second powder metal and a binder to be used as small arms projectiles and shot pellets for use in shot guns which is cost effective to produce and which can perform ballistically. Ballistic performance equal to or superior to that of lead would be offered by a material having a specific gravity equal to or greater than lead. The non-toxic projectiles are manufactured in a cost-effective process; yet still produces projectiles and shot pellets that can perform ballistically. This projectile composition can perform substantially as well as lead and lead alloys or better without the need to fabricate the composition from a high temperature molten state which requires large amounts of energy input. In one particular embodiment of the invention, the tungsten powder is blended with iron powder and Portland Cement for constructing projectiles. The tungsten, iron and Portland Cement (W/Fe Portland cement) shot provides a satisfactory substitute for lead shot.

22 Claims, 1 Drawing Sheet

AMMUNITION USING NON-TOXIC METALS AND BINDERS

FIELD OF THE INVENTION

The present invention relates generally to the fields of polymers and high-density compositions. More particularly, it concerns materials that may act as a replacement for lead in applications requiring lead's high density, but where the toxic effects of lead are undesirable. Further, the high-density composites of the present invention may be employed in any application where a high-density material is required.

DESCRIPTION OF RELATED ART

Shotshells containing lead shot pellets in current use have demonstrated highly predictable characteristics particularly when used in plastic walled shot shells with plastic shotcups. These characteristics include uniform pattern densities with a wide variety of shotgun chokes and barrel lengths, and uniform muzzle velocities with various commercially available smokeless powders. All of these characteristics contribute to lead shots efficacy on game, particularly upland game and bird hunting. This characteristic predictability has also enabled the user to confidently select appropriate shot sizes and loads for his or her own equipment for hunting or target shooting conditions. Steel shot has a lower density than lead and currently does not offer the same predictability. Each hunting season is prefaced with new commercial offerings of ammunitions to ameliorate one or more of the disadvantages associated with the use of steel shot which disadvantages include lower muzzle velocities, poor pattern density and lower energy per pellet delivered to the target. Most, if not all, of these disadvantages could be overcome by the use of shot shell pellets which approximated the specific gravity of the lead or lead alloy pellets previously employed in most shot shell applications. With the increased concern for the perceived adverse environmental impact resulting from the use of lead containing pellets in shotgun shot shells there has been a need for finding a suitable substitute for the use of lead that addresses both the environmental concerns surrounding the use of lead while retaining the predictable behavior of lead in hunting and target shooting applications.

Presently steel is typically employed as a non-toxic material in shot. Steel shot pellets generally have a specific gravity of about 7.5 to 8.0, while lead and lead alloy pellets have a specific gravity of about 10 to 11. Further, lead is more ductile and its greater weight per unit volume permits its use with relatively fast burning smokeless powder and a variety of barrel chokes. This produces an effective predictable muzzle velocity for various barrel lengths and provides a uniform pattern at pre-selected test distances. These are important criteria for both target shooting such as sporting clays; trap and skeet as well as upland game and bird hunting. Conversely, steel shot pellets do not deform; this has necessitated the production of shot shells having two or more pellet sizes to produce better pattern densities. Unfortunately, the smaller pellet sizes, while providing better patterns, do not deliver as much energy as do the larger pellets under the same powder load conditions. Also, because steel shot is not as ductile as lead it can scratch and scrape standard shotgun barrels requiring special barrels to be designed for steel shot.

Other alloys than steel such as a tungsten based alloy have been substituted as an alternative material to lead in shot pellets. Tungsten powder is relatively non-toxic and is suitable for commercial applications. However because solid metallic tungsten is a very hard material and melts at an extremely high temperature (approx. 3410 C., the highest melting point of all metals) it requires a large amount of heating and as a result is very expensive to mold and cast. The present formulations allows for injection and compression molding thus avoiding difficulties that may be encountered with working with pure tungsten. Alloy compositions including tungsten therein and other metals such as iron melt at a slightly lower temperature 3000° F. but this alloy still requires significant energy input to melt the alloy see U.S. Pat. No. 5,527,376 to Amick et al. The cost of energy used to melt these compositions is prohibitive to using a sintering process in forming a tungsten alloy Further, the dynamics of the shot pellets are significantly affected by pellet hardness, density and shape, and it is important in finding a suitable substitute for lead pellets to consider the interaction of all those factors. However, the pattern density and shot velocity of lead shot is critical for on-target accuracy and efficacy have thus far been nearly impossible to duplicate with environmentally non-toxic, safe economical substitutes.

At target shoot areas expensive cleanup procedures must be employed that provide only a temporary solution to the problem. A non-toxic cost effective replacement projectile core material is required to enable firing ranges to remain open and to eliminate costly cleanup procedures. The density of the projectile should be close to that of a lead projectile for realistic performance simulation. Materials of a lower density decrease projectile range and penetration.

In addition, there is mounting concern over the use of lead shot for bird hunting, due to ingestion of the shot by birds and other animals as well as contamination of wetland areas. Indeed there has been legislation in the United States and other countries which bans the use of lead shots in waterfowl shots.

SUMMARY OF THE INVENTION

Figure 1:
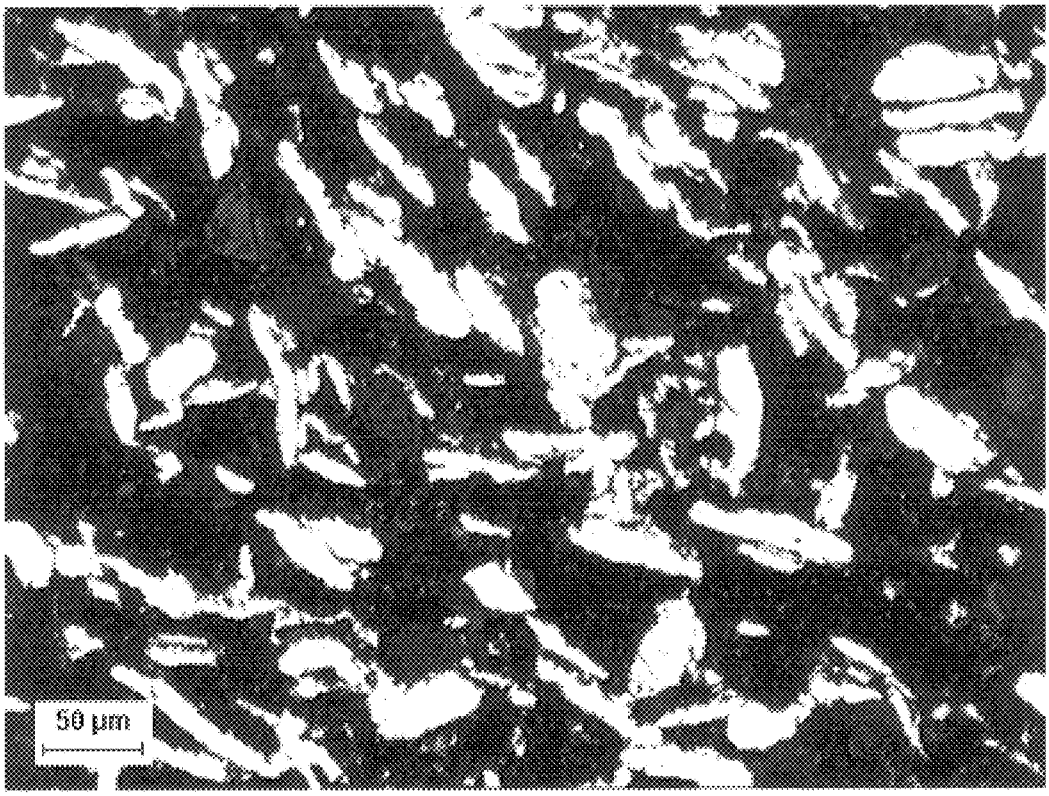
FIG. 1 is a photomicrograph taken at 200× of the Tungsten-Iron-Type I Portland Cement W4F4C2 (see table I)shot pellet.

The present invention, in a general and overall sense, concerns a family of materials that may act as a replacement for lead in applications where the high density of lead is important, but where the toxicity of lead is undesirable. Thus, there is presented in a particular aspect a high-density composite for use in applications in which lead or any other high-density material may be required.

The non-toxic projectile core technology of the present invention may be used to legally replace lead shotgun pellets, now prohibited for use in waterfowl hunting. Under Title 50 chapter 1 of the WILDLIFE AND FISHERIES code of federal regulations sec 20.134, (50 CFR 20.134 Nontoxic Shot) 15,000 mg/kg (LD50) of undiluted shot is considered nontoxic shot. Therefore to be considered nontoxic shot, at least 50% of the test animals (mouse) must be able to survive (nonlethal) the ingestion of at least 15,000 mg of undiluted shot per kilogram of animal body weight. In accordance with the present invention tungsten along with a supplemental metal is used to form pellets that will have similar performance to lead shot but is not toxic to waterfowl and other game. Current steel shot is not toxic but is not as dense as lead, making it an undesirable material in lead shot replacement. Rifled slugs for shotguns and air rifle pellets may also be manufactured utilizing the non-toxic tungsten formulations according to the present invention Thus in a particular embodiment of the present invention, there is provided a high-density composition of matter, comprising tungsten, a supplemental metal and a binder material. In particular embodiments, the tungsten comprises between about 20% and about 40% by volume of the composite. In other embodiments, the tungsten comprises between about 50% and about 80% of the composite volume. In alternate embodiments, the tungsten comprises between about 25% and about 50% of the composite volume. In other embodiments, the tungsten comprises between about 35% and about 45% of the composite volume. High performance very similar to lead shot is achieved by compositions wherein tungsten comprises about 40% of the composite volume. Of course these are exemplary percentages and the tungsten may comprise any percentage between these figures. From economic perspective tungsten is currently the most expensive component at 40% volume. In order to reduce costs the volume of tungsten can be somewhat reduced, however the desired objective of obtaining a density equivalent to lead 11 g/cc must not be significantly compromised. A satisfactory balance between cost and shot pattern performance must be weighed in determining the proper percentage of tungsten used in the composition.

The supplemental metal powder of the present invention is mixed with the tungsten powder to form the projectile composition is generally a lead free metal alloy or metal. Commercially available tungsten powders are mixed and pressed with softer and lighter non-toxic metals, such as iron, tin, brass, bronze or zinc, to generate lead substitute materials with a range of densities as high as, or even higher than, that of lead. Iron powder has been found to be a successful supplemental metal for mixing with tungsten powder and a binder in achieving a shot pellet with ballistic characteristics comparable to lead.

An object of this invention is to use relatively high specific gravity tungsten containing alloys as small arms projectiles and shot pellets for use in shot guns which are cost effective to produce and which can perform ballistically. Ballistic performance equal to or superior to that of lead would be offered by a material having a specific gravity equal to or greater than lead.

Another object of their invention is to provide a process which is cost effective to produce and which can perform ballistically, as well as lead and lead alloys or better without the need to fabricate the composition from a high temperature molten state which requires large amounts of energy input.

In one embodiment of the invention the tungsten powder, iron powder and Portland Cement Type I are employed in constructing projectiles. The tungsten, iron and Type I Portland Cement (W/Fe Portland cement) shot provides a satisfactory nontoxic substitute for lead shot.

In another embodiment of the present invention the binder is a polymeric binder. In particular aspects the polymeric binder may be selected from the group consisting of cellulose, sugars, starches, grain flours, gelatins, gums or waxes.

In more specific embodiments the binder comprises between about 1% to about 40% volume ratio of the composite. In other embodiments, the binder is at a concentration of about 5% to about 20% volume ratio. In still further embodiments, the binder comprises between about 5% to about 15% volume ratio of the composite. In other embodiments, the binder comprises between about 8% to about 12% volume ratio of the composite. The binder will typically have the lowest density of the components; therefor minimizing the percentage of binder will maximize the composite density. However from an economic perspective the binder is normally the least expensive component. A 20% volume amount achieves very satisfactory results.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

The present invention provides compositions that may be used as lead substitutes, having a density similar to or greater than lead and being substantially less toxic to the user. The compositions of the present invention thus provide a new, relatively non-toxic, high performance replacement for metallic lead that can play a part in the ongoing transition from environmentally hazardous materials to ecologically acceptable ones. The compositions of the invention will be useful not only in the manufacture of ammunitions but also in any applications requiring the use of a high-density material.

The shot pattern for a gun is influenced the most by drag as the shot pellets move through the atmosphere. The drag coefficient is related to the shape and size of the pellets. All shot pellets are spherical to prevent harm and damage to the gun barrel.

Lead has a specific gravity of about 11 gm/cc is ductile and the present off-the-shelf shot guns have barrels, chokes and powders that are designed to accommodate lead shot in hunting and target practice. The shot pattern of the same size spherically shaped shot pellets is most effected by the density of the shot material. The range of an individual shot pellet is directly proportional to the momentum of the pellet (mass×velocity). When two identically sized shot pellets are discharged under the same environmental conditions the shot pellet with the greatest density ("mass") will be projected the greatest distance. The drag forces encountered by both pellets discharged at approximately the same speed into the same environment are equivalent.

$$F(drag) = M \times \frac{dV}{dt} \tag{1}$$

The momentum of moving objects is decreased by drag forces imparted on the moving object by the ambient atmosphere into which the object is projected. In the above equation, the drag force is equal to the mass multiplied by the change in velocity rate. The mass (M) is calculated by multiplying the volume of the spherical pellet by the density of the pellet material. In identically sized sphere pellets, the mass (M) of the pellet made from the material with higher specific density is greatest. Therefore, a larger drag force must be required to slow-down a pellet of greater density (i.e. mass). Or the same drag force (such as the ambient atmosphere) must be applied for a longer period of time to stop the momentum of a pellet having a greater density. Accordingly, the shot pellet constructed from a material having a greater specific gravity will travel a greater distance since it has greater momentum and the drag force must be applied for a longer period of time to resist this momentum.

A survey of the periodic table of elements shows that metals with densities higher than lead (such as silver, gold, tungsten, platinum, palladium, bismuth) are considerably more expensive than and have previously been rejected as possible replacements for lead on grounds of affordability, however the methods and compositions of the present invention make these materials a useful and affordable alternative to lead in some applications.

Non-toxic metals such as iron, zinc and tin are also potential candidates to replace lead but being less dense than lead may suffer from problems arising from lower projectile mass and matching the trajectory of lead projectiles. However, the present invention circumvents this problem by providing methods of making composite materials that make the material more dense by combining these elements with a material having a higher specific gravity than lead. Tungsten was determined to be one of the least expensive alternative high-density substitutes for lead.

The great advantage of tungsten as a lead substitute material is that, in addition to being comparatively non-toxic, it has a very high density (19.25 g/cc). Commercially available tungsten powders can therefore be mixed and pressed with softer and lighter non-toxic metals, such as iron, tin, brass, bronze or zinc, to generate lead substitute materials with a range of densities as high as, or even higher than, that of lead. Lead has a density of 11 gm/cc much lower than tungsten's thus less dense materials can be mixed with high density tungsten to obtain an average cumulative shot density much closer to leads 11 gm/cc. For instance, iron has a specific gravity of 7.86 gm/cc. Because the specific gravity of Iron is 7.86 gm/cc its ballistic performance results for any given size is characterized by decreased force or energy compared to lead and lead alloys. To obtain an iron/tungsten composition that has a specific gravity of 11 gm/cc, the composition would have to be 72% iron and 28% tungsten.

In certain applications where projectiles are made employing tungsten or any of the other non-toxic metals disclosed herein as a component; it is possible to demonstrate a uniform blending of the metal powders and binders listed herein, essential to ensure consistent shot pellets and other projectiles described in the present invention. Furthermore, the composite projectiles and shot pellets match standard ball ammunition, both in weight and trajectory, over realistic training distances.

Once tungsten was selected as the candidate metal powder, a search was performed to identify potential binders for the tungsten powder. As used herein a "binder" is a material that is used to provide cohesion between the high-density metal powder and the Iron powders such that the integrity of the iron and tungsten is maintained.

In one embodiment of the invention the tungsten powder, iron powder and Type I Portland Cement are employed in constructing projectiles. The tungsten, iron and Type I Portland Cement (W/Fe Portland Cement) shot provides a satisfactory substitute for lead shot. The Type I Portland Cement binder demonstrates good "Green" strength and ductility for being formed. In comparison to other less desirable organic binders, the Type I Portland Cement principally is an inorganic mixture essentially consisting of four main ingredients tricalcium-silicte, dicalcium-silicate, tricalcium aluminate and tetra-calcium aluminoferrite. However, Type I Portland Cement is considered to be non-toxic. Type I Portland Cement is commonly available and is used in a variety of concrete applications.

In the present process of manufacturing the tungsten/iron powders compostions are not sintered. The tungsten and iron powders are mixed with type I Portland Cement and placed in a pellet shaped dye, pressed and formed into a pellet. In one manufacturing method the diameter of the dye form for the pellet is approximately 0.162". Between 1,400–1,600 pounds force are applied to the dye forming a density of approximately 91% of the theoretical density of the composition. This pellet is then placed into a pan of water for approximately an hour and removed from the water to dry at room temperature for an hour into a strong dense pellet. Alternatively the shot pellet compositions can be agglomerated such as by pan pelletizing or using an aqueous binder spray followed by curing at room temperature. The tungsten powder used in manufacturing the shot pellets had a grain size of 5 microns and the iron powder a grain size of 50 microns. Satisfactory results are achievable for tungsten and iron powder grain sizes both in the range of 1–100 microns.

The non-toxic substitute shot composition can be formed by mixing together tungsten, Portland cement and iron powder in proper proportions into a consistent blend. The mixed blend is then placed into a die cavity on a uniaxial pill press. The blend is compacted using the press to form a green pellet held together by the composition properties inherent in Portland cement binder. The pellet is then moistened in water to produce a curing effect in the Portland cement. Upon drying, this curing strengthens the binder properties resulting in a strongly bound matrix of tungsten and iron particles.

The table below lists some of the various compositions of tungsten, iron, and Portland cement used to make pellets that were designed to give densities comparable to lead-based materials. The desired density for further development was greater than 10 g/cc.

TABLE I

| Composition | Volume % | | | Pellet Theoreticl Density |
|---|---|---|---|---|
| W + Fe + Cement | Tungsten | Iron | Cement | (g/cc) |
| W2F75C05 | 20% | 75% | 5% | 9.922 |
| W3F3C4 | 30% | 30% | 40% | 9.4042 |
| W4F2C4 | 40% | 20% | 40% | 10.5468 |
| W4F3C3 | 40% | 30% | 30% | 11.0212 |
| W4F4C2 | 40% | 40% | 20% | 11.4956 |
| W5F2C3 | 50% | 20% | 30% | 12.1638 |
| W3F6CI | 30% | 60% | 10% | 10.8274 |
| W3F5C2 | 30% | 50% | 20% | 10.353 |
| W35F45C2 | 35% | 45% | 20% | 10.9243 |

FIG. 1 illustrates a polished photomicrograph of the W4F4C2 composition taken from the above table. The black sections represent the Type I Portland Cement and the white sections represent both the tungsten and iron powder. The photomicrograph was taken at a magnification of 200×.

The Portland cement binder added greatly to the strength of the shot pellets in comparison to other binders. A strength test was performed on non-toxic compositions including the compositions shown above in the pellet table. A pellet crush strength was performed as a guide for suitability of compositions as substitute shot pellets. Shot pellets are subjected to high explosive pressures inside the barrel of shotguns. Typically, the crushing load applied to a pellet whenever a shotgun is discharged is over 20 lbs on each pellet.

The crushing strength test was performed by taking samples of these W/Fe/Portland cement compositions and other binder compositions pressed into 0.5" diameter×0.3" long cylinders using a uniaxial compaction press. The cylinders were compressed at 20,000 pounds force resulting in a density range of 72–81% of the theoretical density of the composition. The cylinders were then appropriately dunked in water and cured. These cylinders were then diametrically compressed by applying a radial force load on the curved peripheral surface of the cylinders. The testing method was based on the formula:

$$T=2P/(Dt)$$

where T=Tensile Strength (psi)

P=Applied Load (lbs.)

D=Diameter (inches)

t=thickness (inches)

TABLE II

| Material | Sample | Diametral Compressive Load (lbs) | Diametral Tensile Strength (psi) | Pellet Density (g/cc) | Pellet Crush Strength (lbs.) |
|---|---|---|---|---|---|
| 30% Tungsten, | 1 | 631 | 2606 | 10.46 | 15 |
| 70% Iron | 2 | 600 | 2479 | | 11 |
| (% volume) | 3 | 610 | 2529 | | |
| 30% Tungsten, | 1 | 306 | 1249 | | |
| 65% Iron, | 2 | 296 | 1205 | | |
| 5% Cornstarch | 3 | 290 | 1180 | | |
| 30% Tungsten, | 1 | 232 | 937 | | |
| 60% Iron, | 2 | 228 | 919 | | |
| 10% Cornstarch | 3 | 246 | 996 | | |
| 30% Tungsten, | 1 | 178 | 714 | | |
| 50% Iron, | 2 | 196 | 789 | | |
| 20% Cornstarch | 3 | 180 | 722 | | |
| 40% Tungsten, | 1 | 100 | 380 | | |
| 40% Iron, | 2 | 112 | 426 | | |
| 20% Cornstarch | 3 | 108 | 412 | | |
| 45% Tungsten, 55% Portland Cement - | | | | | |
| Cured H2O | 1 | 673 | 2664 | | |
| Cured H2O | 2 | 610 | 2426 | | |
| Cured H2O | 3 | 679 | 2696 | | |
| 40% Tungsten, 30% Iron, 30% Cement - | | | | | |
| Cured H2O | 1 | 607 | 2346 | 9.96 | 36 |
| Cured H2O | 2 | 631 | 2438 | | 43 |
| Cured H2O | 3 | 650 | 2513 | | |
| Uncured | 4 | 215 | 830 | | |
| Uncured | 5 | 227 | 876 | | |
| 40% Tungsten, 40% Iron, 20% Cement - | | | | | |
| Cured H2O | 1 | 600 | 2341 | 10.44 | 40 |
| Cured H2O | 2 | 565 | 2209 | | 35 |
| Cured H2O | 3 | 575 | 2247 | | |
| Uncured | 4 | 276 | 1078 | | |
| Uncured | 5 | 243 | 948 | | |

The Portland cement binder compositions W4F3C3 and W4F4C2 substantially out performed other non-toxic binders such as cornstarch and were equal to compacted tungsten and iron in this diametrical testing method (see Table II).

A second test was also performed on "pellets" made from the sample compositions having a diameter of 0.18". These spherical pellets were placed between two flat platens. The load at which the pellet was fractured was measure as an indication of the overall strength. In this test the W/Fe/Portland cement compositions had a strength of more than two-fold (2×) the pellet crush strength of compacted W/Fe (see Table II).

In other embodiments of the present invention the binder is a polymeric binder. The selection criteria used to form this list of potential polymeric binder materials included good ductility (high elongation values), high strength and good cohesion. In particular aspects the polymeric binder may be selected from the group consisting of cellulose, sugars, starches, grain flours, gelatins, gums, or waxes.

The invention employs a binder material that results in a frangible composite non-toxic pellet. The binder in combination with iron powder and tungsten powder as components are frangible but the invention compositions tend to have adequate penetration against metal targets. Hence the present invention composition may be used in the manufacture of practice ammunition for all types of rifles and pistols. If the lead-free projectiles are also frangible, they can be employed in situations when ricochet poses a danger to property or even persons. Applications for frangible non-toxic projectiles include indoor/outdoor firing ranges or hunting at close ranges outdoors.

The properties of the invention's composition may be varied as well by the use of tungsten powders of different particle sizes. A composition may comprise a powder of a single particle size, or the composition may comprise a tungsten powder blend with a distribution of different particle sizes.

Alternatively the tungsten/iron binder composition can be used to coat lead shot and steel shot forming a lubricating/protective coating that adheres to the pellets. The coating forms a non-sticking type surface to other similarly coated pellets and is resistance to abrasion of the pellet against the steel barrel.

The present invention further provides a high-density plastic composition comprising a mixture of tungsten as the base metal powder, supplement metal powder and binder. In particular embodiments, the tungsten base metal powder may be substituted for by osmium, iridium, platinum, rhenium, gold, tantalum, rhodium, palladium, thallium, silver, molybdenum, bismuth, copper, cobalt, nickel, cadmium and niobium.

What is claimed is:

1. A projectile having a specific gravity of at least about 10.00 gm/cc comprising:

less than 80% by volume tungsten and more than 10% by volume a second metal or metal alloy selected-from the group consisting of iron, tin, brass, pewter, bronze zinc and their mixtures and alloys; and an inorganic binder, wherein said tungsten and said second metal are blended powdered materials that are prepared by curing.

2. The projectile according to claim 1 wherein said projectile is a shot pellet.

3. The projectile according to claim 1 wherein said binder is Portland Cement.

4. The projectile according to claim 3 wherein said binder is at least 5% by volume.

5. The projectile according to claim 1 wherein said volume of tungsten is greater than 50%.

6. The projectile according to claim 1 wherein said volume of tungsten is about 40% tungsten.

7. The projectile according to claim 1 wherein said volume of tungsten is less than or about 21%.

8. The projectile according to claim 1 wherein said inorganic binder comprises at least 5% by volume of said projectile.

9. The projectile according to claim 1 wherein said binder comprises between 5%–20% by volume of said projectile.

10. The projectile according to claim 1 wherein said binder is about by volume 20% of said projectile.

11. The projectile according to claim 9 wherein said volume of tungsten is between 35%–45%.

12. The projectile according to claim 9 wherein said volume of tungsten is between 25–50%.

13. A projectile essentially consisting of;

a) tungsten b) a second metal c) a inorganic binder.

14. The projectile according to claim 13 wherein the inorganic binder is Portland cement.

15. A process for making a projectile comprising the steps of;

a) mixing together tungsten powder with second metal powder and an inorganic binder to form a blend;

b) compacting said blend;

c) adding water to said blend;

d) drying said blend to cure and strengthen said blend into said projectile.

16. The process for making a projectile according to claim 15 wherein said compacting step includes compacting said blend into a mold of desired shape and said drying step is performed at room temperature.

17. A material composition having a specific gravity of at least about 10.00 gm/cc comprising:

less than 80% volume tungsten and more than 10% by volume a second metal selected from the group consisting of iron, tin, brass, pewter, bronze, zinc and their mixtures and alloys; and an inorganic binder, wherein said tungsten and said second metal are blended powdered materials that are prepared by curing.

18. The material composition according to claim 17 wherein said binder is Portland Cement.

19. The material composition according to claim 17 wherein said volume of tungsten is about 40%.

20. The material composition according to claim 17 wherein said volume of tungsten is less than or equal to 21%.

21. The material composition according to claim 17 wherein said binder comprises between 5%–20% by volume of said composition.

22. A projectile having a specific gravity of at least about 9.00 gm/cc comprising:

less than 50% volume tungsten and more than 20% by volume iron; and a Portland Cement binder that is by volume at least 5% of said projectile, wherein said tungsten and said iron are blended powdered materials that are prepared by curing or drying.

* * * * *